United States Patent [19]

LeSire

[11] Patent Number: 4,606,672

[45] Date of Patent: Aug. 19, 1986

[54] CONSTANT UPSTREAM LEVEL GATE

[76] Inventor: James R. LeSire, 4244 35th St., San Diego, Calif. 92104

[21] Appl. No.: 666,925

[22] Filed: Oct. 31, 1984

[51] Int. Cl.[4] ..... E02B 7/42

[52] U.S. Cl. ..... 405/87; 405/92; 405/99; 405/80

[58] Field of Search ..... 405/99, 100, 37, 87–98

[56] References Cited

U.S. PATENT DOCUMENTS

| | | | |
|---|---|---|---|
| 1,062,364 | 5/1913 | Schneider | 405/99 X |
| 2,616,266 | 11/1952 | Hale | 405/100 X |
| 3,683,630 | 8/1972 | Alexandre | 405/100 X |

FOREIGN PATENT DOCUMENTS

| | | | |
|---|---|---|---|
| 165194 | 9/1955 | Australia | 405/100 |
| 222687 | 10/1968 | U.S.S.R. | 405/100 |

OTHER PUBLICATIONS

Engineering News-Record, Aug. 10, 1950, p. 35.

*Primary Examiner*—Dennis L. Taylor
*Attorney, Agent, or Firm*—John J. Murphey

[57] ABSTRACT

An upstream canal flow control device comprising a gate depending down into the flowing stream from a pivotal axis transverse to the stream and an arm extending downstream from the axis and gate containing a ballast to force the gate against stream flow, the ballast adjustable along the arm to cause the gate to retain an upstream water level as a function of the ballast position therealong.

6 Claims, 2 Drawing Figures

CONSTANT UPSTREAM LEVEL GATE

BACKGROUND OF THE INVENTION

1. Field of the Invention

This invention pertains to flow control devices, in particular, open ditch or canal flow devices and more specifically devices to maintain levels in flowing streams and canals.

2. Description of the Prior Art

The inventor has commissioned a patent novelty search on the invention and the following prior art was uncovered:

| Patent Number | Origin | Date | Classification |
|---|---|---|---|
| 1,062,364 | U.S.A. | May 20, 1913 | 405/94 |

This invention is directed to opening and closing a swinging gate to allow irrigation water to flow out of an irrigation waterway into a side ditch by use of a set of blades that rotate in the water flow. It is not a flow control device.

| Patent Number | Origin | Date | Classification |
|---|---|---|---|
| 351,521 | Germany | April 8, 1922 | 405/100 |

This invention is directed to controlling water flow between parallel ditches and utilizes a gate extending from an arm that is bifulcrumed from a distantly mounted ballast.

| | Origin | Date | Classification |
|---|---|---|---|
| | France | October 16, 1952 | 405/100 |

FIG. 9 shows an upstream level maintaining device that comprises a leaf and float element spaced apart from a counterweight mounted on an intermediate pivotal axis. While this is the only upstream level control found in the search, its function is totally different from the instant invention, depending upon a combination of leaf weight and floatation to overcome the counterweight; a complex relationship.

| Patent Number | Origin | Date | Classification |
|---|---|---|---|
| 683,630 | U.S.A. | Sept. 26, 1972 | 61/23 405/100 |

This invention is concerned with devices to link the gate or apron to the cross-frame for precise adjustment and centering of the apron.

While development of downstream level controllers is evidenced the prior art, there is little or no upstream level control development. The need for upstream level control is important. For instance, in the treatment of sewage, any spillage over wiers and dams will cause turbulence and allow release of noxious fumes, such as sulfides. In the treatment of water, such spillage can result in release of costly chlorine that is used to kill bacteria and control algae growth. In other areas, such as in irrigation and water supply canals, control of upstream levels not only reduces water loss but also controls erosion due to turbulence caused by unrestrained water level changes.

The present invention controls upstream levels through a wide range, not limited to the height of the pivoted axis. In addition, the controlled level may be adjusted upward or downward by simply moving the ballast along the arm and the distance of ballast movement may be converted directly into stream level height. Thus, the tedious job of balancing the ballast to achieve a desired controlled level is eliminated. Further, much of the prior art limits the controlled level to the centerline of the pivotal axis. This would seem to pose serious problems of moisture damage to the axis saddles or at least require expensive preventative measures be taken to insure bearing dryness. Finally, this invention controls water level and at the same time, quells any turbulence caused by rapid level changes. Thus, when used in series they can effectively reduce soil erosion and other maladies caused by the flow of turbulent water, as well as provide effective control for large water usage operations such as turbines.

SUMMARY OF THE INVENTION

It is a main object of this invention to provide an upstream level control device that is simple and inexpensive to construct yet will function accurately over a wide range of levels. Further objects include a device that can be mounted outside of water contact for all but the level control gate, a device whose functional control level can be predicted and preset from a formula involving the geometric position of the ballast as opposed to trial and error measurements, and a device devoid of problems associated with water contact with the pivotal axis or its support structure.

DESCRIPTION OF THE PREFERRED EMBODIMENT

Figure 1:
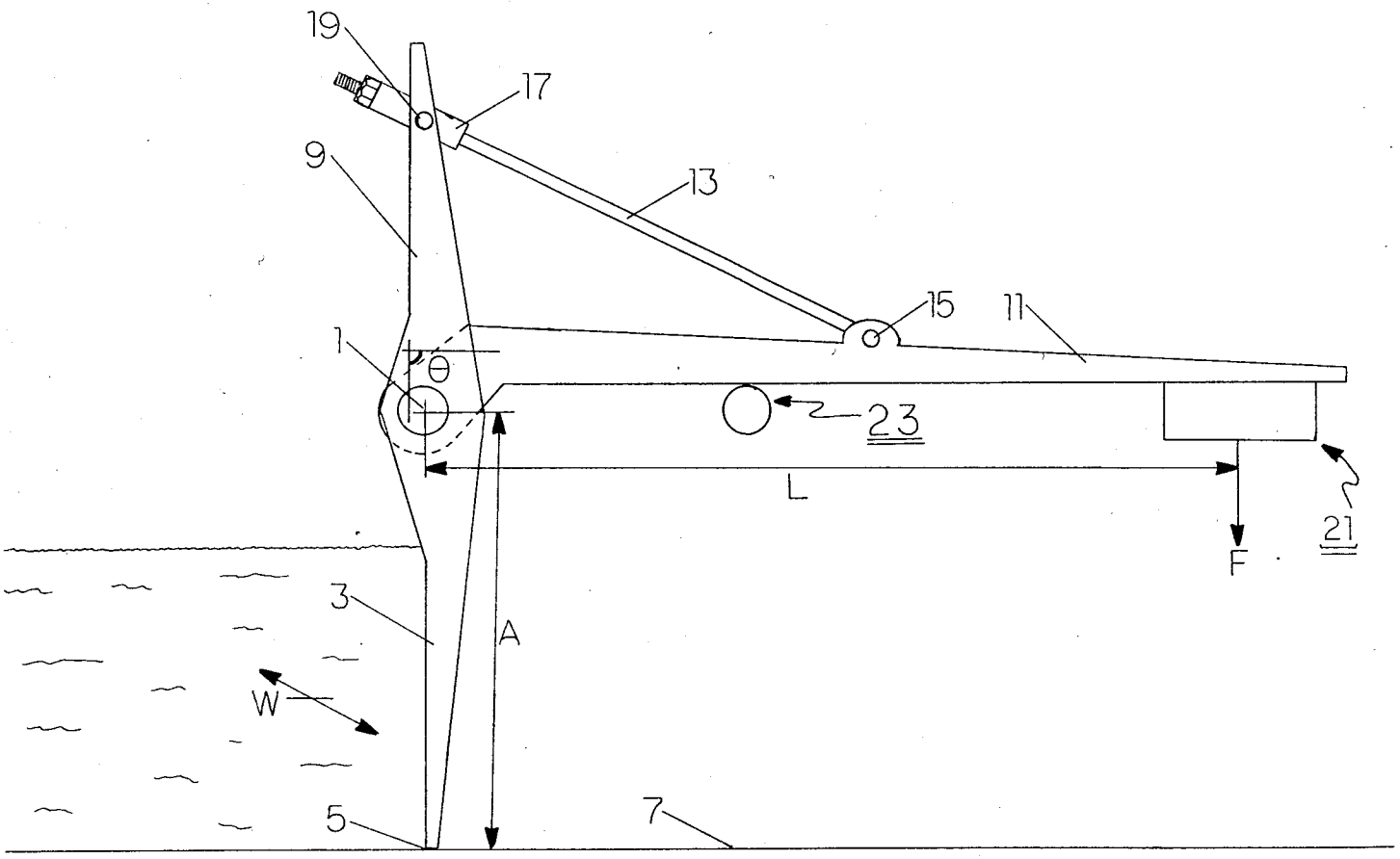
FIG. 1 shows in side elevation one embodiment of this invention in a fully closed position.

In FIG. 1 is shown one embodiment of the invention and comprises a pivotal axis 1 mounted across the full width of a stream in pivots or saddles (not shown) mounted in or on the stream banks (also not shown). Depending from axis 1 is a gate 3 extending vertically to a bottom edge 5 substantially to the bed 7 of the stream, having a width substantially equal to the width of the stream and terminating in an upper extension 9, above axis 1.

Extending downstream and away from gate 3 is an arm 11 that is held in a fixed angle $\theta$, such as 90°, to gate 3 by a brace 13 attached to arm 11 at pin 15 and adjustably fastened to upper extension 9 by a threaded sleeve 17 and pin 19. A ballast or weight means 21 is slidably mounted on arm 11 to force gate 3 to rotate clockwise about axis 1 and come to a vertical rest against a narrow stop or anchor means 23 set above the stream as indicated. Said means 23 operates to stop over (counterclockwise) rotation to gate 3 to prevent a high surge in water level from opening gate 3 so wide as to flip over or be otherwise damaged.

Figure 2:
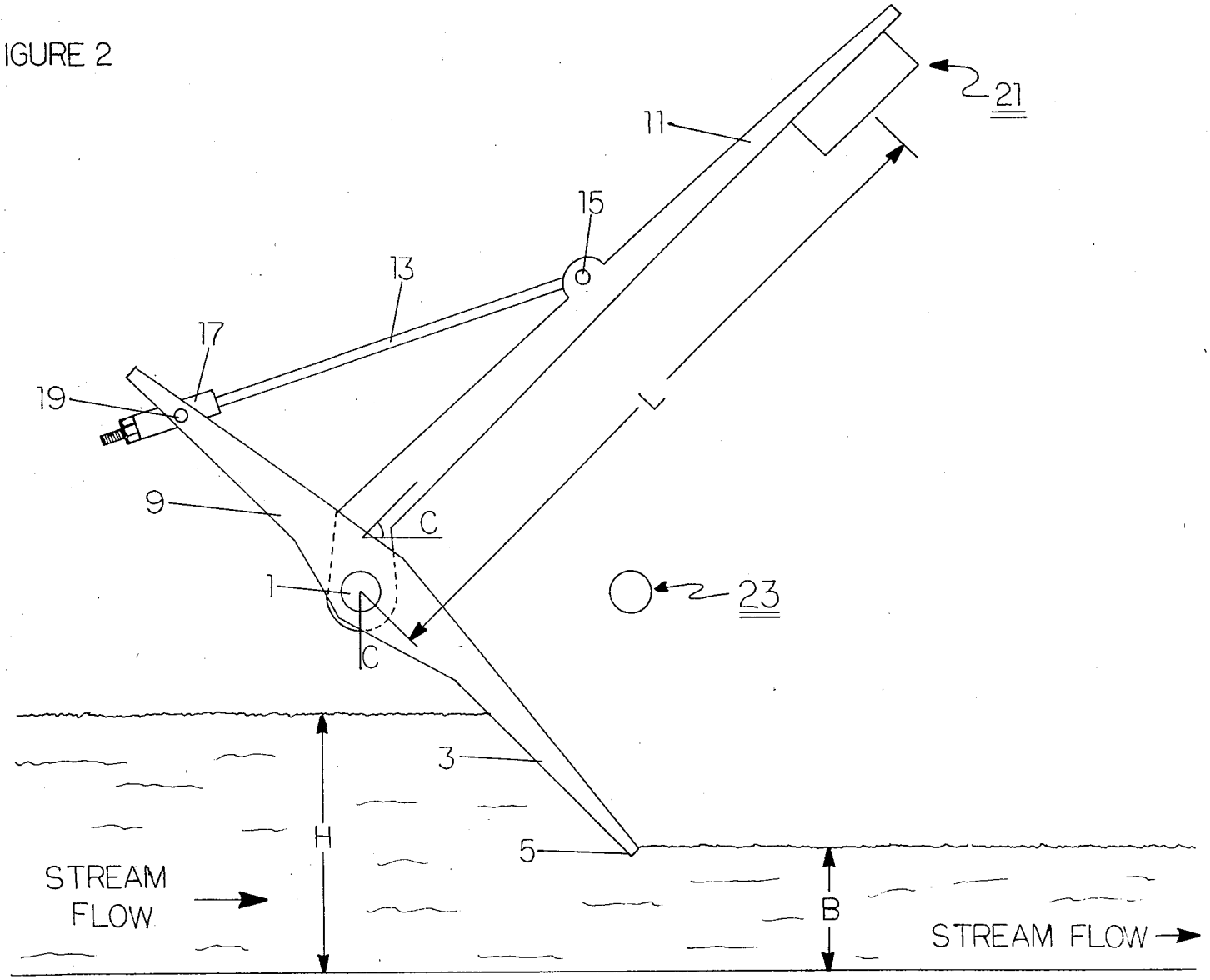
FIG. 2 shows in side elevation the same embodiment as in FIG. 1 in an open position controlling the height of a flowing stream.

FIG. 2 shows the waterstream gate of this invention opened, by sliding ballast means 21 toward axis 1, to allow passage of water downstream. An upstream level can be maintained by adjustment of ballast means 21 along arm 11. The weight of gate 3 is significant because of its size and the heavy materials of construction, i.e., steel beams, etc. Brace 13 can be lengthened or shortened at sleeve 17 to compensate for the weight of gate 3 and bring the operation of this invention within the formula as set forth below.

Labelling the height of gate 3 as "A", the downstream level as "B", the controlled upstream level as "H", the angle of opening (rotation) about axis 1 as "C", the weight (force) of ballast means 21 as "F", the distance between said ballast mean's center of gravity and axis 1 as "L", and the width of the stream (and gate 1) to be "W", the following formula can be established:

$$F \times L \quad (1-\sin \quad C)=[(A-B-)-\tfrac{1}{3}(H-B)]\times\tfrac{1}{2}(62.4\times H-B)\times H-B\times W\times[(1-\cos(C-90°)].$$

EXAMPLE 1

| | | |
|---|---|---|
| Given: | A = 11 feet | |
| | B = 0 feet | F = 7.58 tons |
| | H = 9 feet | |
| | L = 20 feet | |
| | W = 15 feet | |

EXAMPLE 2

| | | |
|---|---|---|
| Given: | A = 11 feet | |
| | B = 3 feet | L = 10 feet |
| | H = 9 feet | |
| | W = 15 feet | |
| | F = 7.58 tons | |

What is claimed is:

1. A waterstream gate, for maintaining a desired upstream level, comprising:

(a) a pivotal axis transverse to the water stream;

(b) a gate depending from said axis directly into the water stream and adapted to move through an arc between a fully closed-off position against the stream bottom and various open positions downstream thereof;

(c) an arm extending downstream from said gate and at a fixed angle thereto; and, (d) ballast means slideably attached to said arm for positioning therealong to create a counterforce to balance the force of the water stream against said gate at any desired upstream level.

2. The gate of claim 1 wherein said angle between said gate and said arm is a right angle.

3. The gate of claim 1 including means to support said axis at the edges of the stream.

4. A waterstream gate, for maintaining a desired upstream level, comprising:

(a) a pivotal axis mounted transverse to and above the flow of the stream;

(b) a non-floating gate, extending the full depth and the full width of the stream, depending from said axis directly into the water stream and adapted to move through an arc between a fully closed-off position against the stream bottom and various open positions downstream thereof;

(c) an arm extending downstream from said axis and at a fixed angle to said gate; and (d) ballast means slideably attached to said arm for positioning therealong to create a counterforce to balance the force of the water stream against said gate at positions between fully closed-off, against stop means anchored in the stream bed below said axis, and downstream open positions at any desired upstream level.

5. The gate of claim 4 wherein said angle between said gate and said arm is a right angle.

6. The gate of claim 4 including means to support said axis at the edges of the stream.

* * * * *